US009486090B2

(12) United States Patent
Juric

(10) Patent No.: US 9,486,090 B2
(45) Date of Patent: Nov. 8, 2016

(54) RETAIL SHELF

(71) Applicant: Nicholas C. Juric, Rockford, IL (US)

(72) Inventor: Nicholas C. Juric, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 95 days.

(21) Appl. No.: 14/184,393

(22) Filed: Feb. 19, 2014

(65) Prior Publication Data

US 2015/0230628 A1 Aug. 20, 2015

(51) Int. Cl.

| | |
|---|---|
| ***A47F 5/08*** | (2006.01) |
| ***A47F 5/00*** | (2006.01) |
| ***A47F 1/12*** | (2006.01) |
| *A47B 47/00* | (2006.01) |
| *A47B 96/02* | (2006.01) |

(52) U.S. Cl.

CPC ..... *A47F 5/005* (2013.01); *A47F 1/12* (2013.01); *A47F 1/125* (2013.01); *A47F 1/126* (2013.01); *A47F 5/0025* (2013.01); *A47F 5/0093* (2013.01); *A47B 47/00* (2013.01); *A47B 96/027* (2013.01)

(58) Field of Classification Search

CPC ..... A47B 96/027

USPC ..... 211/51, 59.2, 59.3, 88.01, 126.15, 211/133.6, 153; 108/108, 110, 159, 159.11; 312/61, 71; 221/198, 279

See application file for complete search history.

(56) References Cited

U.S. PATENT DOCUMENTS

| | | | | | |
|---|---|---|---|---|---|
| 3,102,499 | A * | 9/1963 | Shelor | A47B 57/045 | 108/108 |
| 3,538,860 | A * | 11/1970 | Fisher | F25D 25/02 | 108/1 |
| 3,912,085 | A * | 10/1975 | Cooke | A47B 57/26 | 108/27 |
| 3,984,163 | A * | 10/1976 | Boorman, Jr. | A47B 46/00 | 312/296 |
| 3,993,002 | A * | 11/1976 | Stroh | A47F 5/13 | 108/102 |
| 4,624,376 | A * | 11/1986 | Bertram | A47B 96/028 | 108/152 |
| 4,736,997 | A * | 4/1988 | Besore | A47F 5/005 | 108/108 |
| 4,762,236 | A * | 8/1988 | Jackle, III | A47F 1/126 | 211/59.3 |

(Continued)

FOREIGN PATENT DOCUMENTS

CN 102970901 3/2013

OTHER PUBLICATIONS

U.S. Appl. No. 14/204,744, filed Mar. 11, 2014, Nagel.

*Primary Examiner* — Joshua J Michener
*Assistant Examiner* — Devin Barnett
(74) *Attorney, Agent, or Firm* — Reinhart Boerner Van Deuren P.C.

(57) ABSTRACT

A retail shelf is provided. The retail shelf has a front side and a rear side. The retail shelf includes a fixed portion and a displaceable portion. The displaceable portion is configured to be moved between a retracted configuration and an extended configuration relative to the fixed portion. The fixed portion includes a coupling feature configured to couple the fixed portion to a retail display to maintain the location of the fixed portion relative to the retail display. The displaceable portion is configured to support a plurality of retail trays.

13 Claims, 13 Drawing Sheets

(56) References Cited

U.S. PATENT DOCUMENTS 5,012,936 A 5/1991 Crum
5,069,349 A 12/1991 Wear et al.
5,133,463 A 7/1992 Merl
5,205,524 A 4/1993 Cohen
5,340,209 A * 8/1994 Kolbe ..... F25D 25/024 312/334.46
5,390,802 A * 2/1995 Pappagallo ..... A47B 45/00 211/187
5,403,084 A * 4/1995 Kane ..... A47B 96/025 108/93
5,441,338 A * 8/1995 Kane ..... A47B 96/025 108/159
5,456,435 A 10/1995 Sweeney
5,486,046 A * 1/1996 Jernstrom ..... A47B 88/0455 312/408
5,505,315 A * 4/1996 Carroll ..... A47F 1/125 211/51
5,665,304 A 9/1997 Heinen et al.
5,673,801 A 10/1997 Markson
D387,780 S * 12/1997 Sandlin ..... D15/89
5,720,230 A * 2/1998 Mansfield ..... A47F 5/0043 108/108
5,735,589 A * 4/1998 Herrmann ..... B29C 33/123 108/102
5,738,019 A * 4/1998 Parker ..... A47B 46/00 108/108
5,855,283 A 1/1999 Johnson
5,970,887 A * 10/1999 Hardy ..... A47B 46/00 108/108
6,041,720 A * 3/2000 Hardy ..... A47B 96/02 108/60
6,082,558 A 7/2000 Battaglia
6,142,317 A 11/2000 Merl
6,164,462 A 12/2000 Mumford
6,179,136 B1 1/2001 Kluge et al.
6,364,136 B1 4/2002 Weshler et al.
6,375,015 B1 * 4/2002 Wingate ..... A47F 1/126 211/175
6,422,673 B1 * 7/2002 Bienick ..... F25D 25/024 312/351
6,497,185 B1 * 12/2002 Barrett ..... A47B 96/025 108/108
6,520,353 B2 * 2/2003 Fulbright ..... A47B 96/028 108/108
6,719,152 B1 4/2004 Nagel et al.
6,745,906 B1 6/2004 Nagel
6,811,045 B1 * 11/2004 Masker ..... F25D 25/02 211/153
6,866,155 B2 3/2005 Nagel
6,866,156 B2 3/2005 Nagel et al.
6,886,700 B2 5/2005 Nagel
6,889,855 B2 5/2005 Nagel
7,032,761 B2 4/2006 Nagel
7,270,385 B2 * 9/2007 Mathur ..... A47B 96/025 108/108
7,311,211 B2 * 12/2007 Chung ..... A47B 96/021 211/103
D568,344 S * 5/2008 Baacke ..... D15/89
7,419,062 B2 9/2008 Mason
7,458,473 B1 12/2008 Mason
7,494,019 B2 * 2/2009 Kessell ..... A47B 57/06 108/108
7,540,244 B2 * 6/2009 Gregory ..... A47B 96/028 108/108
7,681,744 B2 3/2010 Johnson
7,690,519 B2 4/2010 Kahl et al.
7,854,334 B2 12/2010 Nagel et al.
7,931,156 B2 4/2011 Hardy
7,954,648 B2 * 6/2011 Takashima ..... A47F 5/0846 211/59.3
8,210,367 B2 7/2012 Nagel et al.
8,231,191 B2 * 7/2012 Leconte ..... A47B 96/062 108/108
8,453,851 B2 6/2013 Ciesick
8,899,704 B2 * 12/2014 Bienick ..... A47B 96/028 211/90.02
8,915,561 B2 * 12/2014 Eichman ..... F25D 25/025 108/108
9,044,089 B1 * 6/2015 Sandhu ..... A47B 88/044
2003/0136750 A1 * 7/2003 Fujii ..... A47F 5/0093 211/90.02
2003/0160012 A1 * 8/2003 Kanouchi ..... A47F 5/0093 211/59.2
2003/0173876 A1 * 9/2003 Fujii ..... A47F 3/063 312/116
2004/0036391 A1 * 2/2004 Vardon ..... A47B 96/021 312/408
2005/0127014 A1 6/2005 Richter et al.
2005/0145147 A1 * 7/2005 Costa ..... A47B 47/022 108/108
2006/0186065 A1 8/2006 Ciesick
2006/0273053 A1 12/2006 Roslof et al.
2007/0170127 A1 7/2007 Johnson
2007/0175839 A1 8/2007 Schneider et al.
2009/0039040 A1 * 2/2009 Johnson ..... A47F 5/0025 211/120
2009/0200906 A1 8/2009 Dao
2010/0025346 A1 2/2010 Crawbuck et al.
2010/0107670 A1 * 5/2010 Kottke ..... A47F 1/126 62/250
2010/0108624 A1 5/2010 Sparkowski
2010/0176075 A1 7/2010 Nagel et al.
2010/0176077 A1 7/2010 Nagel et al.
2010/0181273 A1 * 7/2010 Nagel ..... A47F 1/126 211/162
2011/0017684 A1 1/2011 Nagel et al.
2011/0210086 A1 9/2011 Ciesick
2011/0290749 A1 * 12/2011 Neumann ..... A47F 1/126 211/59.2
2012/0255924 A1 10/2012 Kologe
2013/0112634 A1 5/2013 Nagel
2013/0193095 A1 8/2013 Nagel
2014/0043162 A1 * 2/2014 Siciliano ..... B65D 83/12 340/568.8
2014/0167962 A1 * 6/2014 Valiulis ..... G08B 13/14 340/568.8
2014/0190913 A1 * 7/2014 Hardy ..... A47F 1/12 211/59.3
2014/0190917 A1 * 7/2014 Szpak ..... A47F 1/04 211/134
2014/0217041 A1 * 8/2014 Johnson ..... A47F 1/04 211/59.2
2014/0305891 A1 * 10/2014 Vogler ..... A47F 1/125 211/59.3
2014/0319086 A1 * 10/2014 Sosso ..... A47F 1/126 211/59.3
2015/0068991 A1 * 3/2015 Kostka ..... A47F 1/126 211/59.3
2015/0083744 A1 * 3/2015 Vogler ..... A47F 1/126 221/154
2015/0096998 A1 * 4/2015 Bird ..... A47F 5/0861 221/1
2015/0108074 A1 * 4/2015 Pichel ..... A47F 5/005 211/59.3
2015/0129520 A1 * 5/2015 Kologe ..... A47F 1/126 211/59.3
2015/0157142 A1 * 6/2015 Turner ..... A47F 1/125 211/59.3
2015/0164241 A1 * 6/2015 Nagel ..... A47F 1/125 211/59.3

* cited by examiner

RETAIL SHELF

FIELD OF THE INVENTION

This invention generally relates to retail merchandise displays, and more particularly to retail merchandise displays configured for filling from the rear.

BACKGROUND OF THE INVENTION

Self-facing retail merchandise displays such as pusher systems incorporate one or more pusher paddles or pusher bodies that ride along a respective elongated track. A spring is connected between the pusher body and a leading edge of the track. The spring acts to bias the pusher body forward along the track towards the leading edge thereof.

A user can retract the pusher body away from the leading edge of the track and position items of retail merchandise in a linear row on top of the track and between the leading edge of the track and the pusher body. The biasing force provided by the spring and exerted upon the pusher body serves to bias the linear row of retail merchandise forward to ultimately "front face" the merchandise.

That is, when a customer removes the leading most item of merchandise from the linear row of merchandise, the pusher body will be drawn forward by the spring to index the row of merchandise forward so that the next item of merchandise in the row is positioned proximate the leading edge of the track in an aesthetically pleasing manner. Such automatic front facing eliminates the necessity for retail store employees to manually face the merchandise, and thus ultimately reduces the cost of labor of the retailer.

Some products in the retail industry, e.g., perishable goods, may be utilized as first in first out (FIFO) inventory. For example, perishable goods, such as for example, bagged salad, may be loaded in an open back cooler from behind a retail display containing these perishable goods so as to be utilized as first in first out inventory. However, there are certain retail displays that do not allow for such rear loading access.

For example, as is well known in the art, retail merchandise gondola-type displays or the like utilize an upright back wall (e.g. a peg board) from which retail display assemblies such as shelving with or without pusher systems situated thereon, hooks, etc. depend outwardly therefrom in a cantilever manner. As such, there is no rear access due to the upright wall, and such displays have heretofore been avoided in the context of FIFO type inventory. Indeed, it is possible to remove all prior loaded merchandise therefrom, to then situate new, fresher, merchandise in the rear to maintain a FIFO type arrangement. However, such a process is typically avoided due to the inefficiencies and labor required in effectuating the same.

Accordingly, there is a need in the art for a retail merchandise system, particularly a pusher system, that will allow for rear loading of merchandise in the pusher system without the need to access the pusher system from the rear. Such a system could be advantageously employed in the above described gondola-type displays that have an upright rear wall that prevents access to the system from behind. Embodiments of the invention provide such a pusher system. These and other advantages of embodiments of the invention, as well as additional inventive features, will be apparent from the description of the invention provided herein.

BRIEF SUMMARY OF THE INVENTION

In one aspect, a retail shelf is provided. The retail shelf has a front side and a rear side. The retail shelf includes a first portion and a displaceable portion. The displaceable portion is configured to be moved between a retracted configuration and an extended configuration relative to the first portion. The first portion includes a coupling feature configured to couple the first portion to a retail display to maintain the location of the first portion relative to the retail display. The displaceable portion is configured to support a plurality of retail trays.

In another aspect, a retail display is provided. The retail display includes a closed back wall. The retail display includes a retail shelf supported within the retail display. The retail shelf includes a first portion and a displaceable portion movable between a retracted configuration and an extended configuration relative to the fixed position. The retail display includes at least one tray supported on the retail shelf. The tray includes a front side configured to be proximate a customer and a rear side configured to be distal from the customer. The retail shelf is configured such that in its extended configuration, merchandise may be loaded into a portion of the tray proximate the rear side of the tray.

In yet another aspect, a retail shelf is provided. The retail shelf includes a first portion. The retail shelf includes a displaceable portion configured to be displaced between a retracted configuration and an extended configuration relative to the first portion. The retail shelf includes a securing feature. The securing feature is configured to move between a first configuration and a second configuration, the securing feature being configured to deter movement of the displaceable portion from the retracted configuration to the extended configuration in the first configuration and to allow movement of the displaceable portion from the retracted configuration to the extended configuration in the second configuration. The first portion includes a pair of outer sidewalls, a front bar, and a rear bar, the front and rear bars extending between the sidewalls. The first portion includes a coupling feature configured to couple to a retail display to maintain the location of the first portion relative to the retail display. The displaceable portion includes a pair of inner sidewalls, each of the inner sidewalls being located inwardly of the respective one of the outer sidewalls, a first support and a second support, the first and second supports extending between the inner sidewalls. The displaceable portion includes inwardly extending walls extending inwardly from each of the inner sidewalls. The displaceable portion includes a third support supported by the first support and the second support. The displaceable portion includes a baffle extending between the inwardly extending walls and supported by the inwardly extending walls and the third support.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
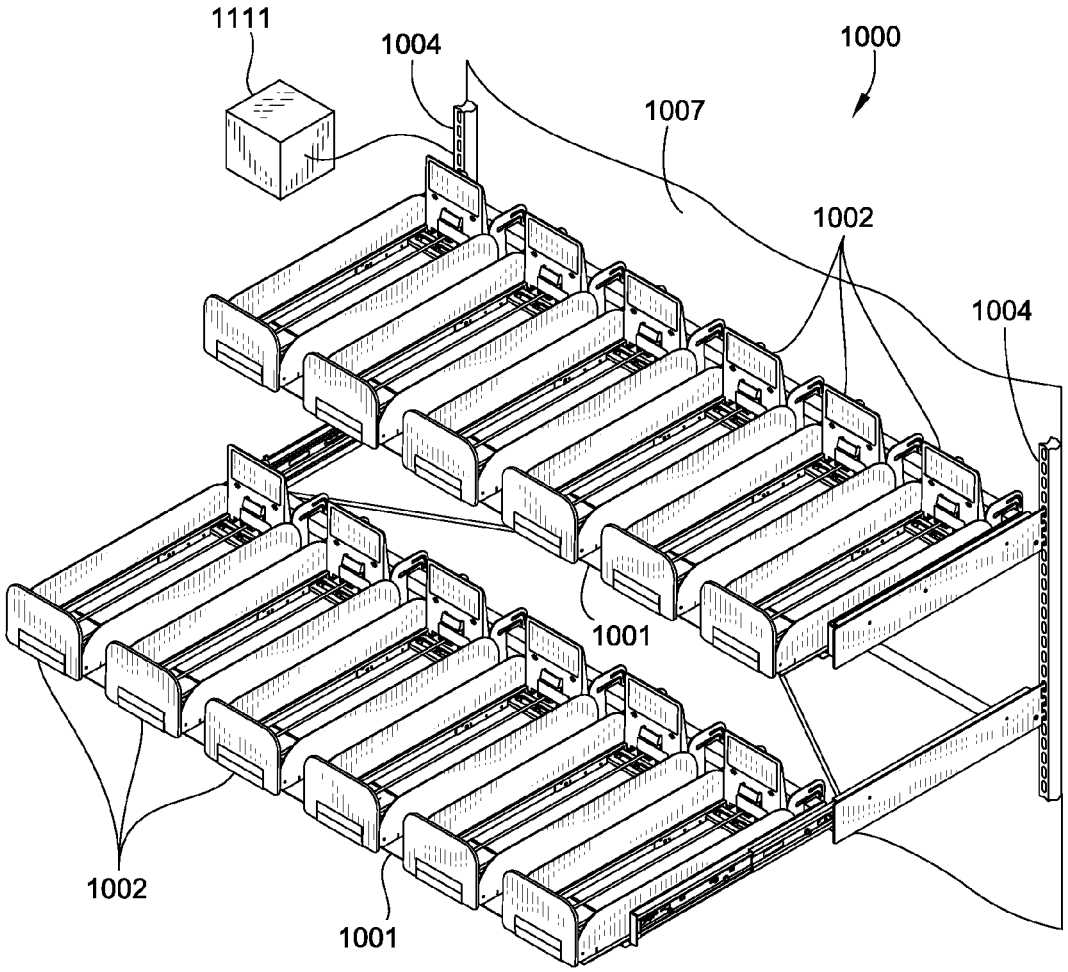
FIG. 1 is a perspective view of a display with a closed back and an embodiment of a retail shelf in an extended configuration supporting a plurality of merchandise trays.

With reference to FIG. 1, an embodiment of a retail display 1000 is illustrated. The display 1000 includes a plurality of supports for trays, e.g., retail drawers, etc., shown as retail shelves 1001 supporting rows of trays 1002. The retail shelves 1001 in various embodiments may be used to support various different embodiments of trays, as further described below. In one embodiment, the retail display 1000 is a closed rear side retail display, e.g., the trays 1002 cannot be accessed from the rear side of the display, for example, the side of the display opposite the consumer display side. The consumer display side is shown as the side through which consumers may remove products from the display 1000. The retail display 1000 has a closed back wall 1007.

Generally, some products may be dispensed from a retail display to a consumer in a first in first out ("FIFO") manner, e.g., the oldest products are dispensed before newer products. FIFO products, for example, perishables, e.g., bagged salad, may be placed into a tray for retail display. Then, after some of the FIFO products have been removed from the tray by consumers, the tray may be restocked. It may be desirable to locate new FIFO products farther away from the consumer in the tray than those FIFO products remaining in the tray. However, retail displays such as the retail display 1000 illustrated in FIG. 1 do not have rear access, e.g. access to the trays from the side opposite the side accessed by consumers. In one embodiment, the retail shelves 1001 allow each row of trays to be pulled forward to allow loading of new FIFO products to the portions of the trays distal from consumers, e.g., allowing the older FIFO products to remain closer to consumers in the trays, for example promoting consumer withdrawal of older FIFO products through the open front of the retail display 1000 before withdrawal of newer FIFO products. The retail shelves 1001 may allow for loading of the FIFO products into the trays 1002 without first removing the older product remaining in the trays 1002, which may be advantageous, e.g., save time, duplicative effort removing older product and then reloading older product into the trays 1002 after the new product has been added, etc.

The central shelf 1001 in FIG. 1 includes a moveable portion and a fixed portion. The central shelf 1001 in FIG. 1 is illustrated in a loading configuration, e.g., with the moveable portion in an extended configuration relative to the fixed portion. The shelves 1001 are coupled to vertical support members 1004, e.g., the fixed portions are fixed to the vertical support members 1004. The consumer display 1000 will be further described below with reference to an open, front consumer side and a closed rear side opposite the open, front consumer side.

The display 1000 may be a display that includes a temperature controlling device 1111, e.g., compressor with heat exchanger, refrigeration device, freezing device, etc., that maintains temperature inside the display, e.g., refrigerator, freezer, etc. In one embodiment, the display 1000 also includes a front, consumer side closure (not shown in FIG. 1), e.g., door, plastic hanging covering, etc. The consumer side closure may be openable by a consumer to access merchandise inside the display 1000. The closure may help to maintain temperature within the display 1000. In other embodiments, the display 1000 may be open, e.g., not have a closure, on the front, consumer side.

Figure 2:
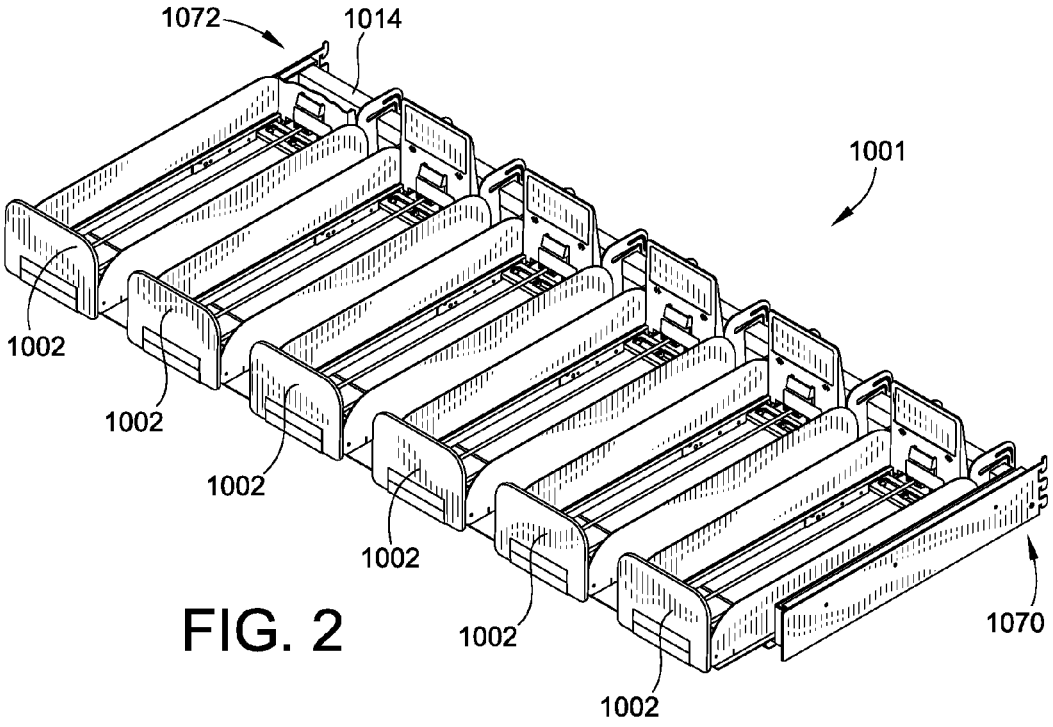
FIG. 2 is a perspective view of an embodiment of a retail shelf.

FIG. 2 illustrates an embodiment of a retail shelf 1001 removed from the retail display 1000 supporting a row of trays 1002. Embodiments of trays will be described first below, followed by a description of embodiments of retail shelves.

Figure 3:
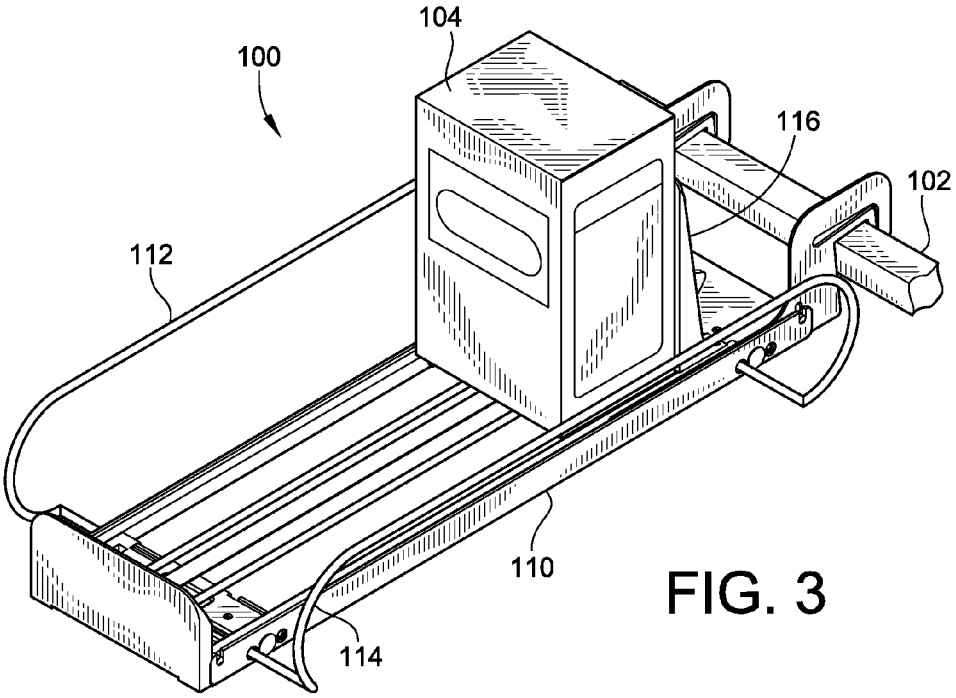
FIG. 3 is a perspective view of an embodiment of a bar mounted merchandise tray with adjustable side barriers.

With reference to FIG. 3, an embodiment of a merchandise pusher tray with adjustable side barriers 100 (hereinafter "tray") is illustrated. It will be understood that tray 100 may be an embodiment of a tray 1002 that may be used in conjunction with a shelf 1001, as shown in FIGS. 1 and 2. In other embodiments, other suitable trays, for example, other embodiments of trays described below, may be used with shelves 1001.

Tray 100 is illustrated mounted to a retail merchandise display bar 102 typically incorporated in a commercial refrigerator or freezer cabinet. For example, the retail merchandise display bar 102 may be an embodiment of the retail merchandise display bar 1014 illustrated in the assembled configuration in FIG. 2.

Tray 100 is loaded with retail merchandise 104 and is operable to bias merchandise 104 forward to front face the same. Although illustrated as incorporated in a commercial refrigerator or freezer-type cabinet, it will be readily recognized that the invention is not limited to this environment alone. Rather, those skilled in the art will recognize from the disclosure herein that the various embodiments of tray 100 can be integrated into other retail displays such as dry goods shelving or the like.

Figure 4:
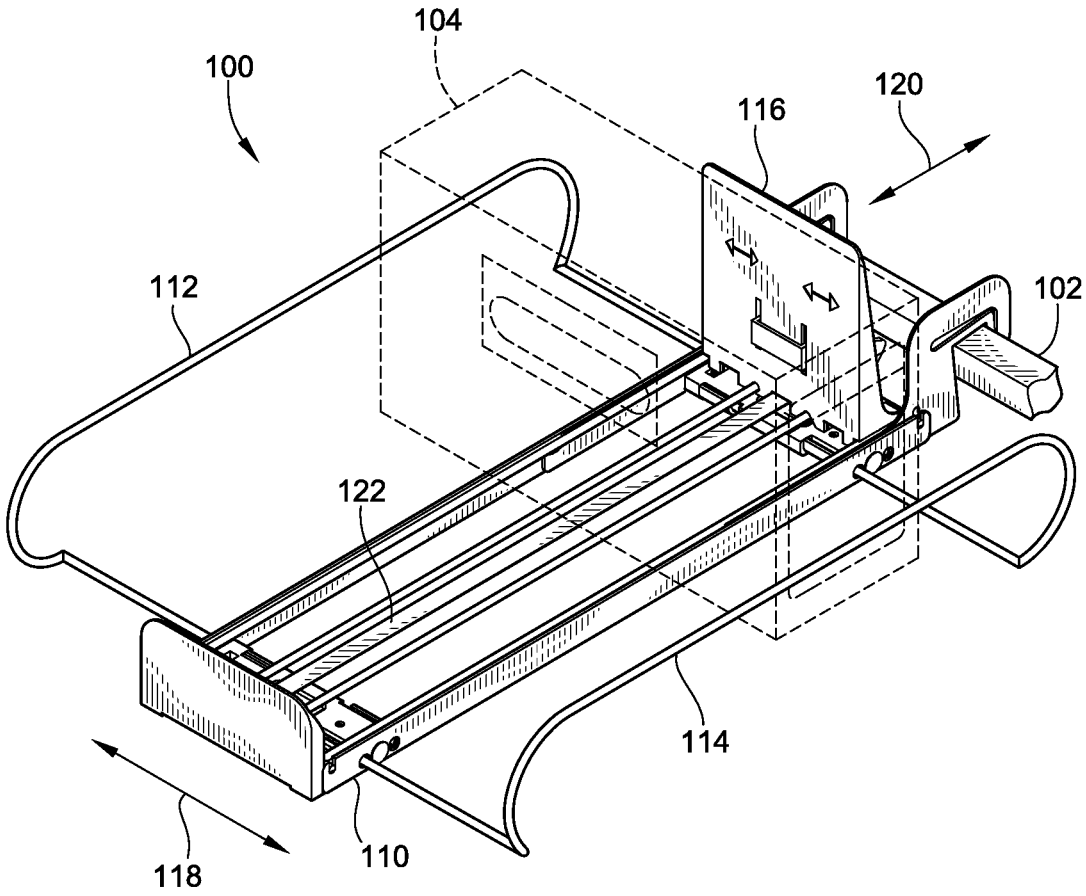
FIG. 4 is a perspective view of the tray of FIG. 3, illustrating the relative motions, respectively, of adjustable side barriers and a pusher assembly of the tray.
Figure 14:
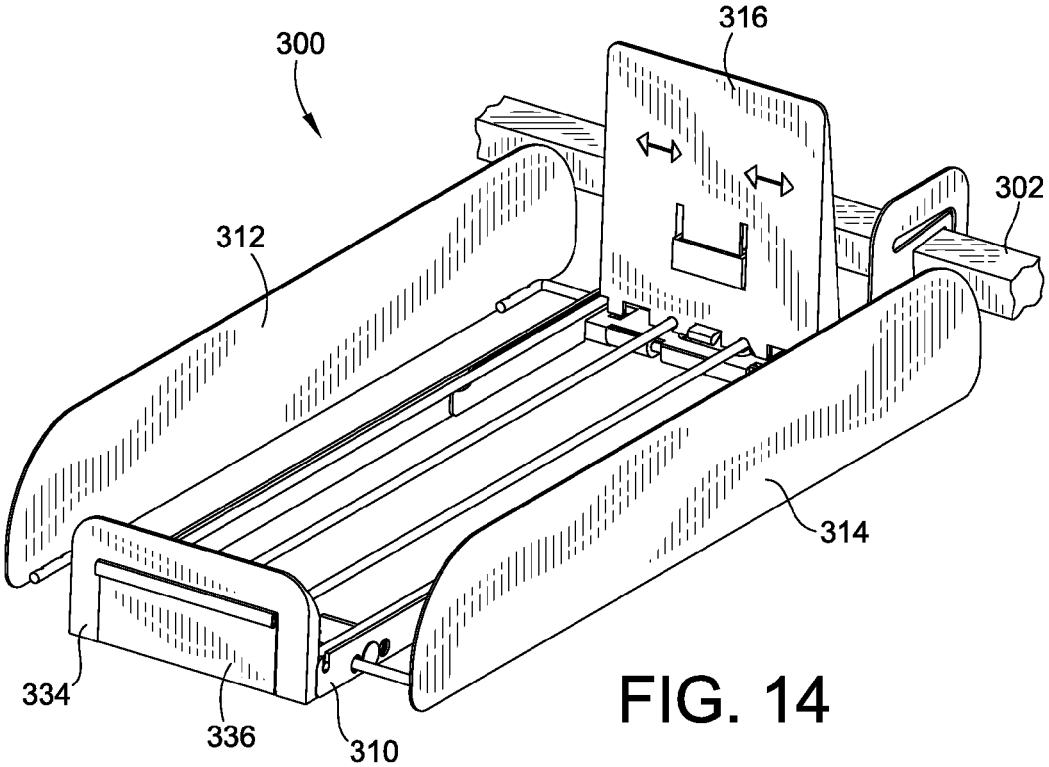
FIG. 14 is a perspective view of a second embodiment of a merchandise pusher tray with adjustable side barriers.
Figure 15:
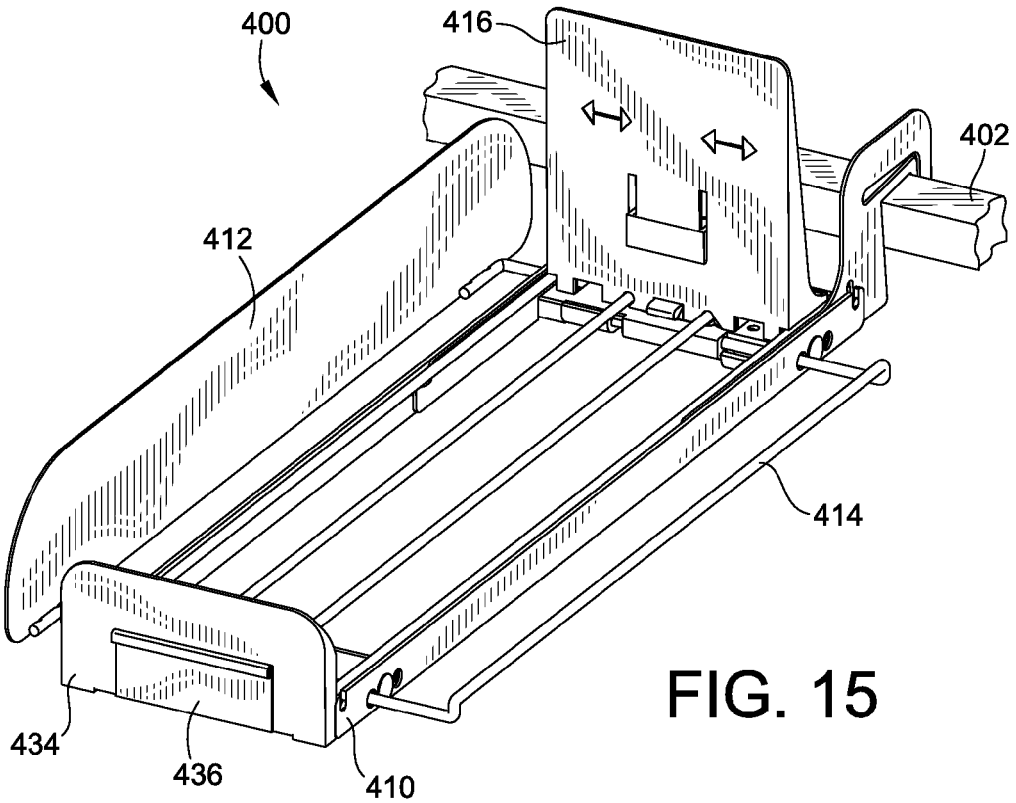
FIG. 15 is a perspective view of a third embodiment of a merchandise pusher tray with adjustable side barriers.

Tray 100 includes a base structure 110. A pair of moveable dividers 112, 114 are mounted to the base structure 110. A pusher 116 is also mounted to base structure 110. With reference to FIG. 4, dividers 112, 114 are moveable relative to base structure 110 in direction 118. This adjustability allows a user to define a width of a retail merchandise channel interposed and defined by the dividers 112, 114. As a result, tray 100 is not limited to a specific width of retail merchandise, and can instead accommodate various widths depending on the particular spacing of dividers 112, 114 set by a user. The dividers 112, 114 may be a wire structure as illustrated, a plate-like structure as shown at FIGS. 14 and 15, or any other barrier style configuration sufficient to define an area for containing items of retail merchandise. Embodiments of trays with dividers of any suitable structure may be used in conjunction with drawer 1001, illustrated in FIGS. 1 and 2.

Pusher 116 is moveable relative to base structure 110 in direction 120. Such movement by pusher 116 accomplishes the front facing of merchandise 104 (See FIG. 3) as described herein. Further, and as will be described in greater detail below, pusher 116 also incorporates an advantageous locking arrangement which is operable to lock pusher 116 in a locked and fully retracted position as illustrated at FIG. 4. This functionality allows a user to lock pusher 116 in the retracted position and thereafter load retail merchandise within the retail merchandise channel defined between dividers 112, 114 without also holding the pusher 116 back against the biasing force provided by spring 122 operably connected to pusher 116.

Figure 5:
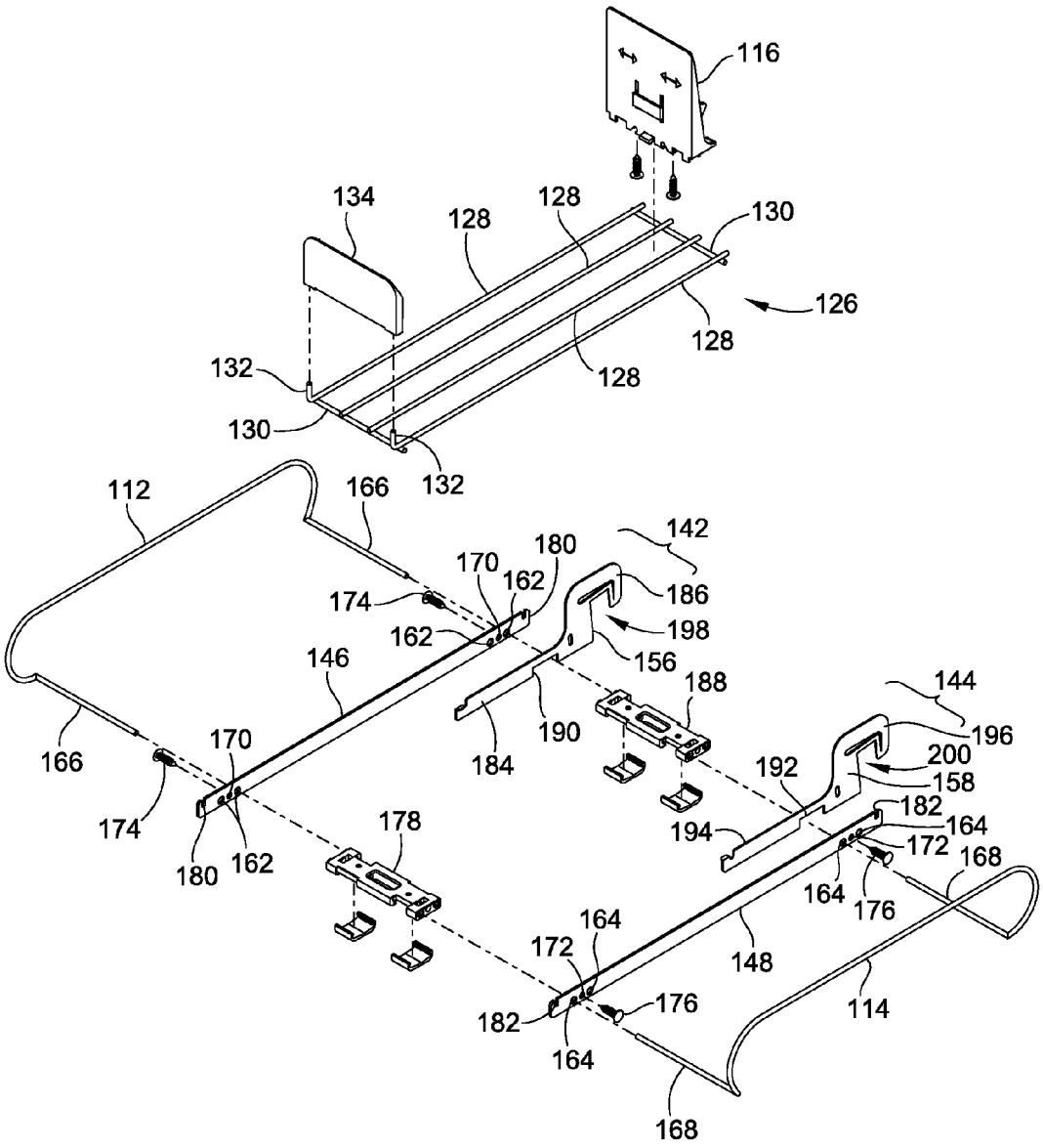
FIG. 5 is an exploded perspective view of the tray of FIG. 3.

Turning now to FIG. 5, with particular attention to base structure 110, the same includes a wire floor 126 which includes a plurality of longitudinal members 128, as well as a plurality of horizontal members 130 welded to the longitudinal members 128. It will be recognized that the particular number of longitudinal members 128 and well as horizontal members 130 illustrated is not limiting, and fewer or more could be used in other embodiments as governed by application. Pusher 116 slidably engages one or more of the longitudinal members 128 of wire floor 126 for movement thereupon.

As shown in FIG. 5, the two outer most longitudinal members 128 include upturned ends 132 for receiving a front stop 134. Front stop 134 defines the front most boundary of the retail merchandise channel at which retail merchandise 104 (See FIG. 1) will abut and be prevented from any further forward travel by front stop 134. Front stop 134 may take on a variety of shapes and sizes, depending upon application, and thus the particular shape/size of front stop 134 is not limiting upon the invention. Further, it will be recognized by those skilled in the art that front stop 134 is interchangeable with other front stops by removing the same from wire frame 126.

Base structure 110 also includes a pair of load bearing members 142, 144. Each load bearing member 142, 144 includes a structural bar 146, 148 and a reinforcing bar 156, 158 arranged in an overlapping fashion. As a result, each load bearing member 142, 144 has a variable cross sectional thickness. In the region of overlap between the structural bars 146, 148 and reinforcement bars 156, 158, each load bearing member 142, 144 will have a first cross sectional thickness. Beyond this region of overlap, each of the load bearing members 142, 144 will have a second cross sectional thickness equal to the thickness of their respective structural bars 146, 148, this second cross sectional thickness being less than the first cross sectional thickness.

Such a configuration provides for an enhanced resistance to deflection under loading due to the cantilevered extension of tray 100, and more particularly load bearing members 140, 142, from merchandise bar 102 (See FIG. 3). It will be recognized by those skilled in the art that such resistance is optimized by the particular size of the region of overlap of each of the load bearing members 142, 144.

Indeed, the region of overlap is a stiffness region wherein load bearing members 142, 144 provide enhanced deflection resistance while simultaneously minimizing the amount of material required to provide such resistance. The remainder of each load bearing member 142, 144 beyond the stiffness region is generally a support region that remains operable to support retail merchandise thereon and provide a sufficient degree of deflection resistance. In one embodiment, the amount of overlap between structural bars 146, 148 and reinforcement bars 156, 158 is about one inch to about ten inches, and preferably about three inches to about eight inches, and even more preferably about four inches to about seven inches.

Each structural bar 146, 148 incorporates apertures 162, 164 for sliding receipt of extensions 166, 168 of dividers 112, 114 respectively. Further, each structural bar 146, 148 also includes apertures 170, 172, respectively, for receipt of pins 174, 176. As will be described in greater detail below, pins 174, 176 are used to fixedly retain spacers 178, 188 between load bearing members 142, 144 to maintain the spacing thereof. Each structural bar 146, 148 also incorporates upwardly opening notches 180, 182, respectively, for receipt of the front and rear horizontal members 130 of wire floor 126. By way of notches 180, 182 the load bearing members 142, 144 support the wire floor 126.

Each reinforcement bar 156, 158 includes a straight portion 184, 194 as well as a mount in the form of a hook portion 186, 196. Each straight portion 184, 194 includes notch 190, 192 to provide clearance for the ends of the rear most spacer 188 such that these ends can abut the structural bar 146, 148 as described below. Each hook portion 186, 196 includes a downwardly opening notch 198, 200 for receipt of the aforementioned merchandise bar 102 (See FIG. 1).

Structural bars 146, 148 are joined to reinforcement bars 156, 158 mechanically by welding or other mechanical means. Such a configuration permits the use of a uniform stock thickness of material to be utilized in manufacturing each of the structural bars 146, 148 and reinforcement bars 156, 158. Further, uniform structural bars 146, 148 may be employed with various combinations of reinforcement bars 156, 158 having differently sized hook portions 186, 198 to accommodate various sizes of merchandise bars 102 (See FIG. 1). Yet further, other mounts may be used instead of hook-style mounts, e.g. slatwall mounts, pegboard mounts, etc.

Figure 6:
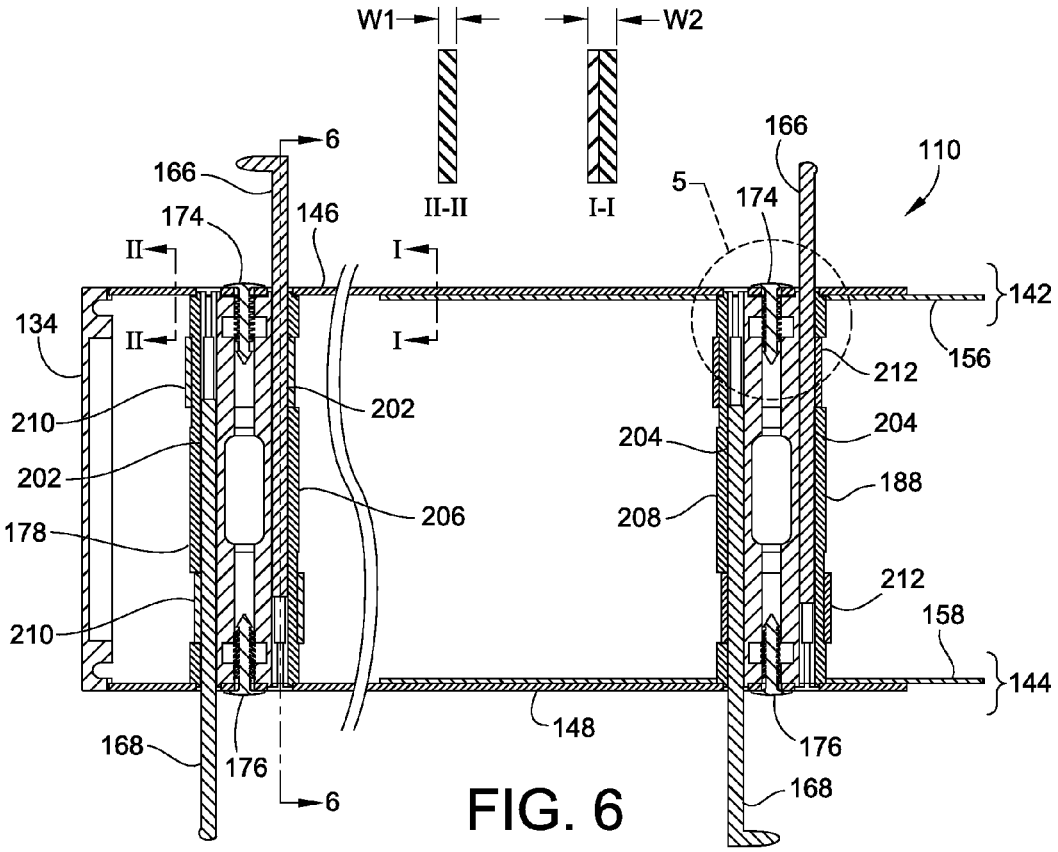
FIG. 6 is a top cross section of the tray of FIG. 3.

Turning now to FIG. 6, a top cross section of the base structure 110 is illustrated. Also illustrated in FIG. 4 is a cross section of the stiffness region (section I-I) having a first cross sectional width W1, as well as the support region having a second cross sectional width W2 at section II-II. Further, the mounted configuration of the spacers 178, 188 is also illustrated. Each spacer 178, 188 receives extensions 166, 168 of each of the respective dividers 112, 114 (See FIG. 5). Each spacer 178, 188 include generally parallel bores 202, 204 respectively. The front most spacer 178 receives extensions 166, 168 in bores 202. Likewise, the rear most spacer 188 receives extensions 166, 168 in bores 204. The bores 202, 204 are formed through a body 206, 208 of each spacer 178, 188.

Further, each spacer 178, 188 incorporates clips 210, 212. Clips 210 are mounted to the front most spacer 178. One clip 210 contacts body 206 at one end of clip 210, while the other end of this clip 210 contacts extension 166. Such contact produces a bearing load against the extension 166 to generally hold the extension 166 in its adjusted position within spacer 178, and more particularly within bore 202. Likewise, the other clip 210 contacts body 206 at one end of the clip 210, while contacting extension 168 at the other end of clip 210. Such contact produces a bearing load against extension 168 to hold it in its adjusted position within bore 202.

For purposes of brevity, it will be recognized that clips 212 mounted to spacer 188 perform in the same manner previously described relative to clips 210. Although illustrated as removable components, clips 210, 212 can also be hingedly connected at one end thereof to the bodies 206, 208 of spacers 178, 188 in another embodiment. In such an embodiment, the clips 210, 212 can rotate about said hinge at one end to contact the extensions 166, 168 at another end of the clips 210, 212 in a similar manner as described above.

Figure 7:
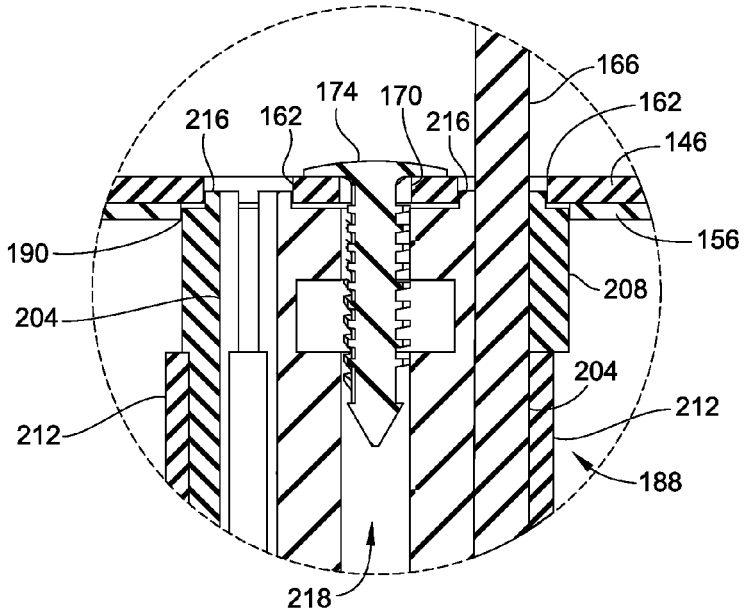
FIG. 7 is a partial view of the cross section of FIG. 6.

Turning now to FIG. 7, the connection of one end of spacer 188 to load bearing member 142 is illustrated. It will be recognized by those skilled in the art that the other end of spacer 188 is connected to load bearing member 144 in the same manner. Further, the ends of spacer 178 are connected to load bearing members 142, 144 in the same manner as well. As shown at FIG. 7, the end of spacer 188 extends through notch 190 formed in reinforcement bar 156. Flanges 216 extending from the ends of bores 204 extend into apertures 162 of the structural bar 146. Flanges 216 thus quickly align spacer 188 relative to apertures 162 of load bearing member 142 and also quickly align bore 218 which extends through body 208 and receives pin 174. It will be recognized by those skilled in the art that pin 174 may be omitted and spacer 188 will be held in place by the interconnection of flanges 216 within apertures 162.

Figure 8:
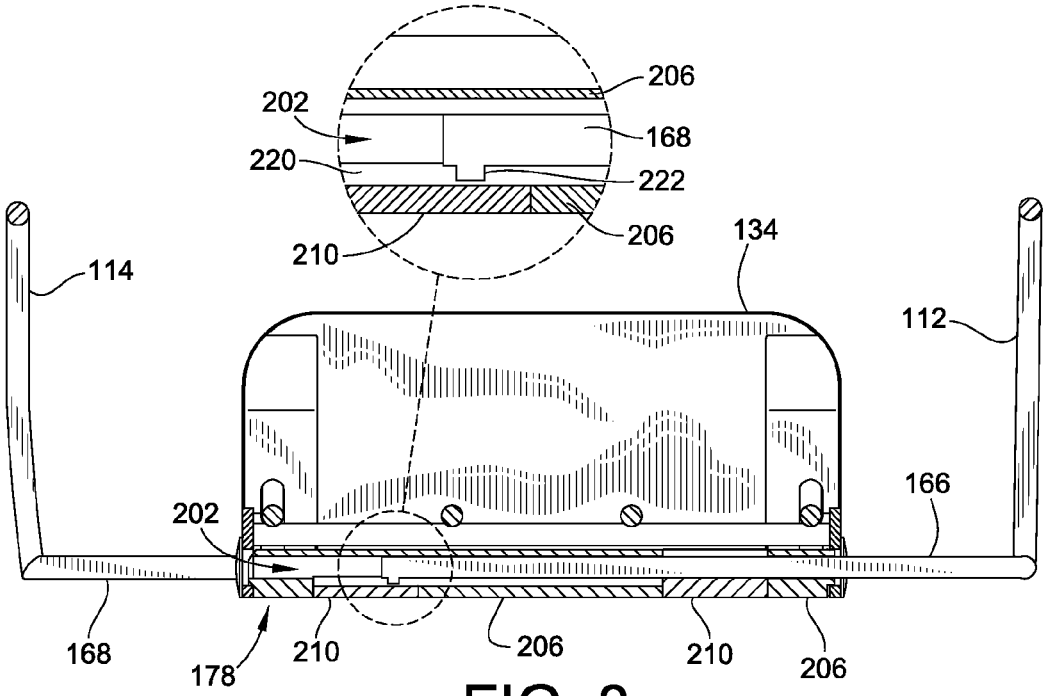
FIG. 8 is a front cross section of the tray of FIG. 3.

Turning now to FIG. 8, a cross-section of bore 202 extending through spacer 178 is illustrated. As illustrated, bore 202 includes a keyway 220. The keyway 220 allows for passage of a key 222 formed at an end of extension 168. Further the left most clip 210 in FIG. 6 also includes a keyway aligned with keyway 220. It will be recognized, however, that the right most clip 210 does not incorporate such a keyway. As a result, key 222 will abut the edge of clip 210 and prevent further movement from left to right of divider 112 as shown in FIG. 8. Such a configuration limits or prevents the divider 112 from being entirely removed from bore 202. Although not shown, a similar configuration is provided in the other bore 202 of spacer 178 to prevent the removal of divider 114. Additionally, spacer 188 incorporates a like configuration such that the dividers 112, 114 are limited to a maximum width position and are not readily removable from the remainder of tray 100.

Figure 9:
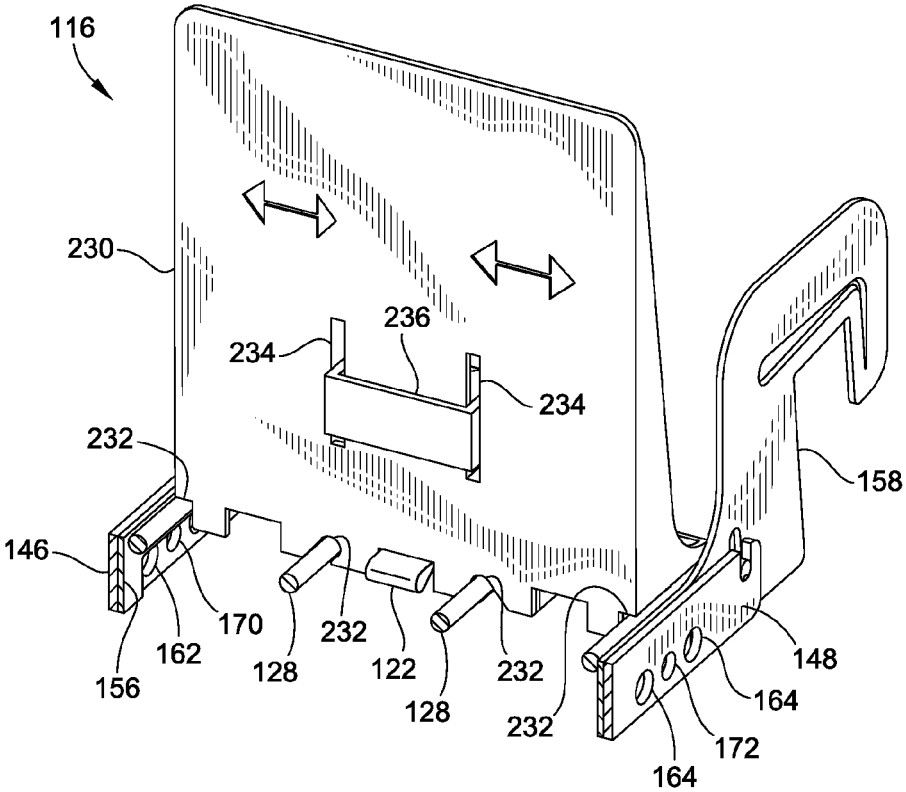
FIG. 9 is a rear cross section of the tray of FIG. 3.

Turning to FIG. 9, the particulars of the pusher 116 will be discussed in greater detail. The pusher 116 includes a pusher body 230 that is a generally upright paddle as illustrated. At a bottom edge of the pusher body 230, there is disposed a plurality of notches 232 that receive longitudinal members 128. The pusher body 230 is slidable along longitudinal members 128 at notches 232. As illustrated, the inner most notches 232 are generally curved, while the outer most notches 232 are generally a right angle cut-out. Pusher body 230 also incorporates a pair of slots 234 therethrough for receipt of a locking arm 236 which will be described in greater detail below. Pusher body 116 also carries spring 122 introduced above at FIG. 4. Those skilled in the art will recognize that pusher body 116 is interchangeable with other sizes of pusher bodies to accommodate differing sizes of retail merchandise.

Figure 10:
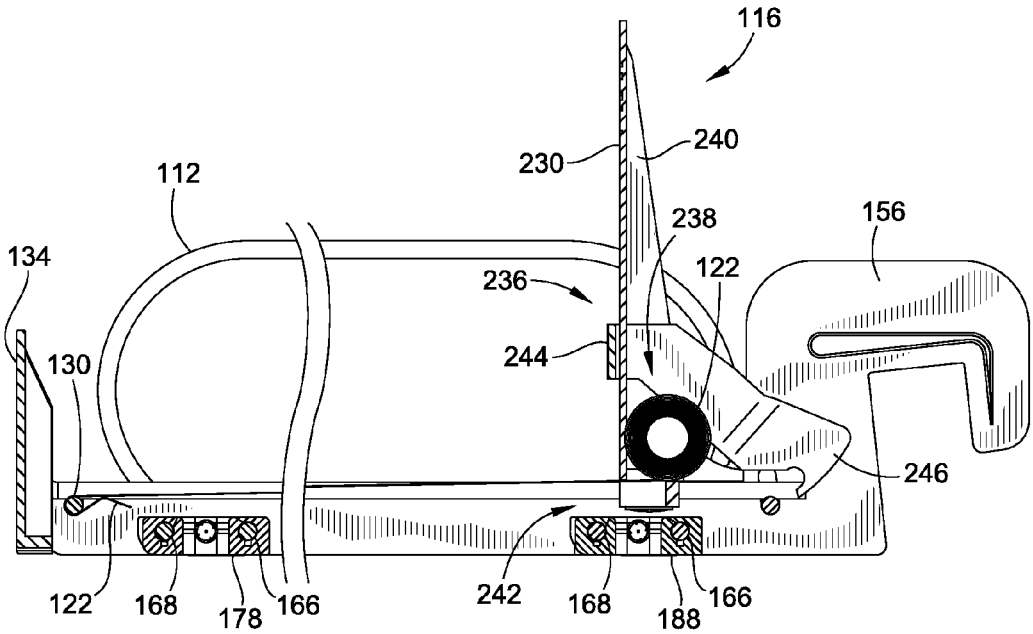
FIG. 10 is a side cross section of the tray of FIG. 3.

More particularly, and with reference now to FIG. 10, spring 122 is carried within an internal cavity 238 of the pusher body 230. The internal cavity 238 is bounded and defined by generally vertical support walls 240 (See also FIG. 9) which support the pusher body 230. As illustrated at FIG. 10, spring 122 is generally a coil spring that extends from internal cavity 238 through opening 242 formed in pusher body 230. A terminal end of spring 122 is fixedly connected to the front most horizontal member 130 of wire floor 126 (See FIG. 5). Alternatively, spring 122 could be attached elsewhere, such as to front stop 134 in other embodiments.

Figure 11:
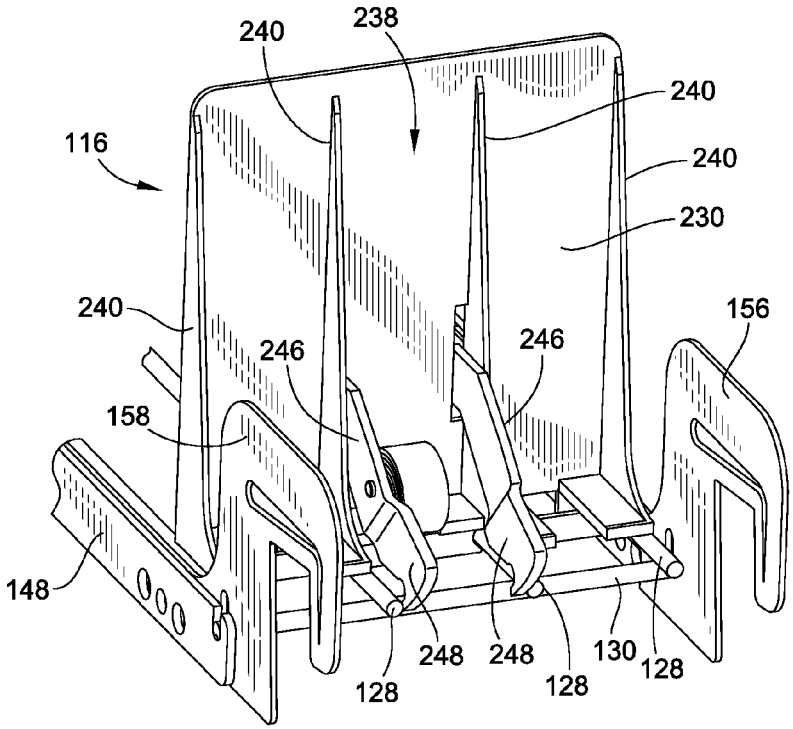
FIG. 11 is a partial top perspective view of the tray of FIG. 3.

Turning now to FIG. 11, the locking arm 236 include a transverse member 244 and a pair of longitudinal members 246. Each of the longitudinal members 246 include a hook portion 248 at an end thereof. The hook portion 248 incorporates a notch 250 for selective receipt of the rear most horizontal member 130.

Figure 12:
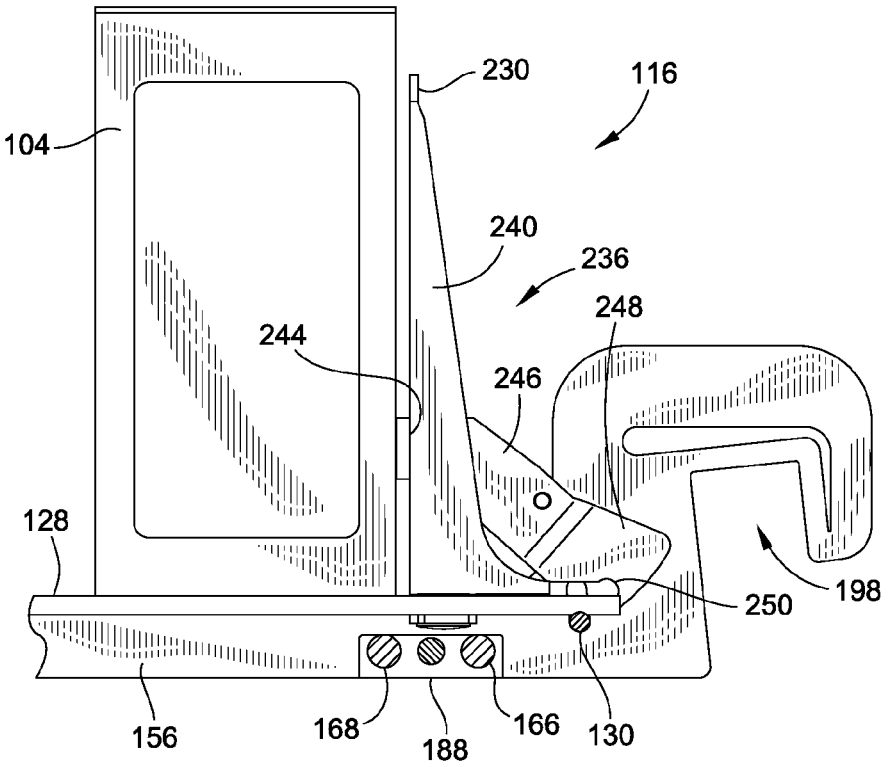
FIG. 12 is a partial side cross section of the pusher assembly of the tray of FIG. 3 in an unlocked configuration.

More specifically, and with reference now to FIG. 12, a portion of the tray 100 is illustrated with retail merchandise 104 carried therein. As illustrated, merchandise 104 is positioned against the transverse member 244 of the locking arm 236 such that the transverse member 244 is generally parallel to the vertically extending front face of the pusher body 230. As a result, notch 250 remains out of contact with the rear most horizontal member 130 of the wire frame 126 (See also FIG. 5).

Figure 13:
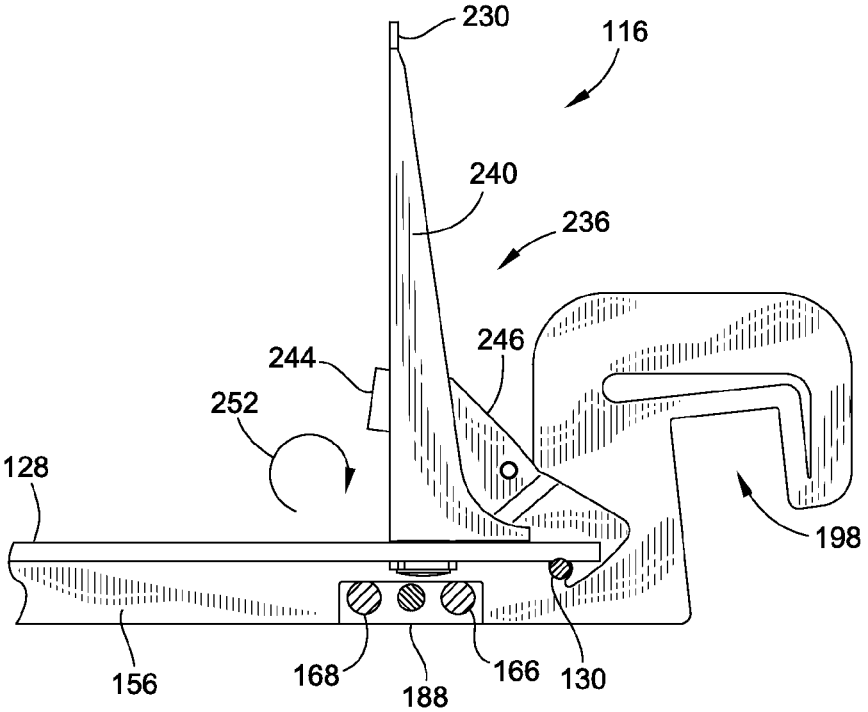
FIG. 13 is a partial side cross section of the pusher assembly of the tray of FIG. 3 in a locked configuration.

However, and referring now to FIG. 13, when tray 100 is unloaded and pusher 116 is at its retracted position, locking arm 236 will rotate in direction 252 as illustrated such that notches 250 of the longitudinal members 246 of the locking arm 236 engage the rear most horizontal member 130 of wire frame 126. Such rotation in direction 252 occurs as a result of the cantilevered extension of longitudinal members 246 out of slots 234 formed in pusher body 230.

Such a configuration allows a user to lock the pusher 116 in place when it is not loaded with merchandise 104 (See FIG. 12). This configuration advantageously allows a user to load tray 100 using two hands, as opposed to holding the pusher 116 in its retracted or rear most position while using another single hand to load tray 100. Put differently, locking arm 236 allows for the two-handed manipulation and loading of merchandise into tray 100. It will be recognized by those skilled in the art that this advantageously overcomes existing designs wherein it is required to hold a pusher with one hand and load merchandise with only a single hand.

Turning now to FIG. 14, another embodiment of a tray 300 is illustrated. This embodiment is generally similar to the embodiment described above with the exception that the tray 300 incorporates solid side dividers 312, 314, as opposed to the wire-type dividers 112, 114 (See FIG. 5) described above. This embodiment of tray 300 also contemplates bar mounting to a merchandise bar 302.

It will be understood that tray 300 may be an embodiment of a tray 1002 that may be used in conjunction with a shelf 1001, as shown in FIGS. 1 and 2. In other embodiments, other suitable trays may be used with shelves 1001.

Tray 300 is illustrated mounted to a retail merchandise display bar 302 typically incorporated in a commercial refrigerator or freezer cabinet. For example, the retail merchandise display bar 302 may be an embodiment of the retail merchandise display bar 1014 illustrated in the assembled configuration in FIG. 2.

Further, this embodiment also incorporates a pusher 316 as described above. Dividers 312, 314 and pusher 316 are mounted to the base structure 310 and are moveable relative thereto in the same manner as described above. Additionally, this embodiment also incorporates an integrated label holder 336 mounted to front stop 334 of tray 300. Integrated label holder 336 is mounted to front stop 334 in such a way that the bottom surface of integrated label holder 336 is flush with a bottom surface of front stop 334. Integrated label holder 336 may also be incorporated with all other embodiments disclosed herein.

Turning now to FIG. 15, another embodiment of a tray 400 is illustrated. This embodiment also is mounted to a retail merchandise bar 402. This embodiment also incorporates a pusher 416 moveable relative to a base structure 410 of the illustrated embodiment. Additionally, tray 400 incorporates moveable dividers 412, 414 that function in the same manner as described above. However, it will be recognized from inspection of FIG. 15 that only one of dividers 412, 410, particularly divider 412, includes a plate-like side member.

It will be understood that tray 400 may be an embodiment of a tray 1002 that may be used in conjunction with a shelf 1001, as shown in FIGS. 1 and 2. In other embodiments, other suitable trays may be used with shelves 1001.

Tray 400 is illustrated mounted to a retail merchandise display bar 402 typically incorporated in a commercial refrigerator or freezer cabinet. For example, the retail merchandise display bar 402 may be an embodiment of the retail merchandise display bar 1014 illustrated in the assembled configuration in FIG. 2.

As illustrated, the other divider 414 is simply a wire. Such an embodiment is particularly advantageous for functioning as an end tray of a row of trays mounted to bar 402. Indeed, this illustrated embodiment presents a left most tray 400 of a row of trays mounted to bar 402. In an embodiment not illustrated, the plate-like divider is reversed such that divider 414 contains an upright plate-like member while divider 412 is simply a wire. Such an embodiment would function as a right most tray of a plurality of trays mounted to bar 402.

Although not illustrated, all of the aforementioned embodiments can omit the movable dividers 112, 114, 312, 314, 412, 414 entirely and still achieve the various advantages described herein. Further, the embodiments shown at FIGS. 12-14 incorporate all of the features of the embodiment described at FIGS. 1-11, with the exception of the differences identified in the preceding.

Figure 16:
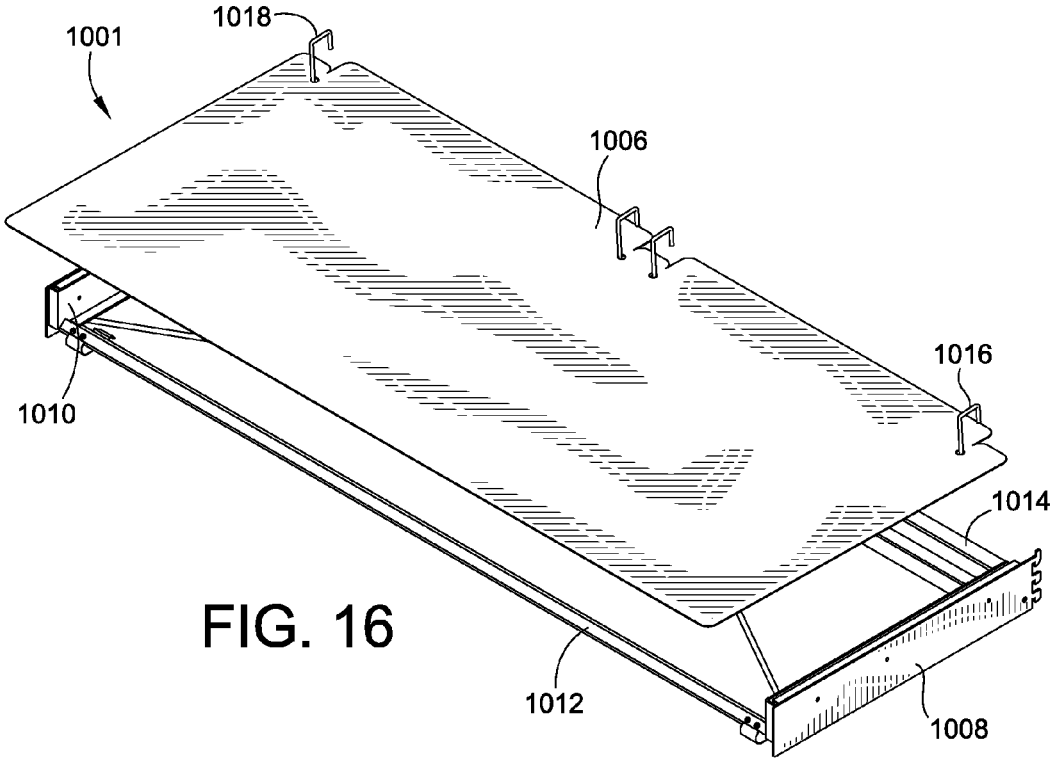
FIG. 16 is a perspective view of an embodiment of a retail shelf without merchandise trays illustrating the baffle of the retail shelf in an exploded configuration.
Figure 17:
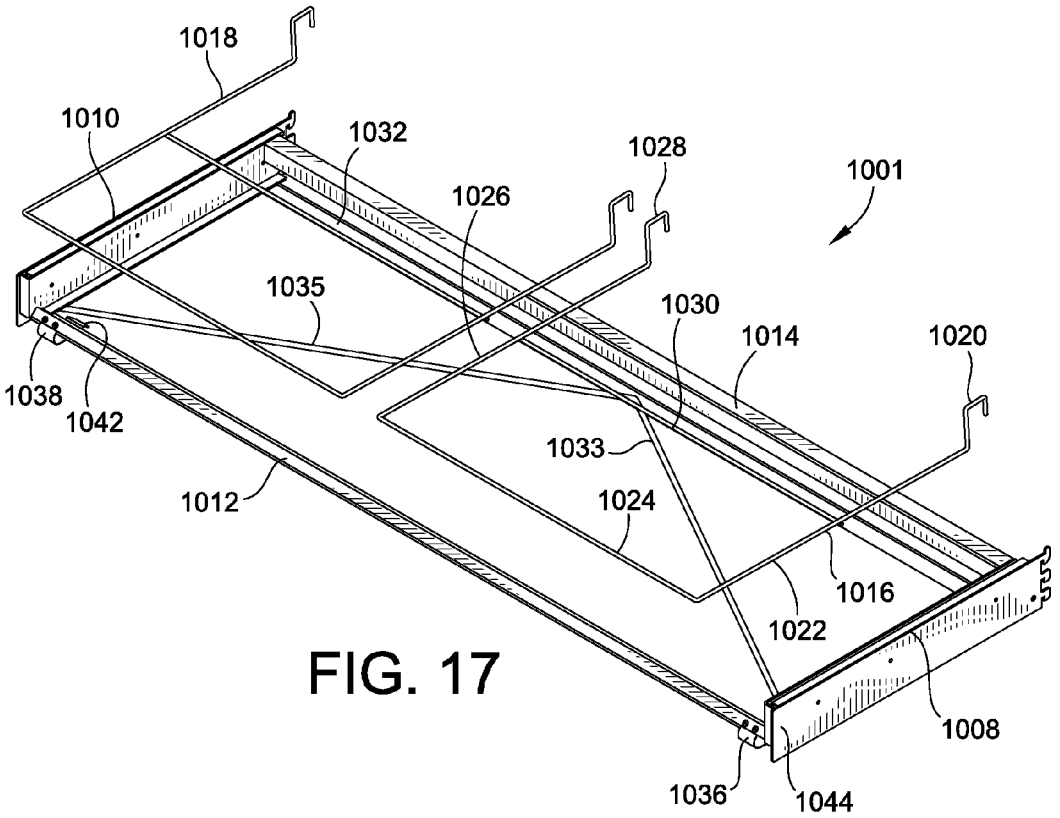
FIG. 17 is a right side perspective view of an embodiment of a retail shelf with the baffle removed and wire support hangers an exploded configuration.

FIG. 16 illustrates an embodiment of a retail shelf 1001, with the trays removed. The retail shelf 1001 is shown in a partially exploded configuration. The shelf 1001 includes a baffle 1006, a first sidewall 1008, a second sidewall 1010 opposite the first sidewall, a front bar 1012 proximate to the customer side, the front bar 1012 extending between the first sidewall 1008 and the second sidewall 1010, and a rear retail merchandise display bar 1014 distal from the customer side, the display bar 1014 extending between the first sidewall 1008 and the second sidewall 1010. With reference to FIGS. 16 and 17, the baffle 1006 extends from the first sidewall 1008 to the second sidewall 1010, and from the front bar 1012 to the rear bar 1014. In one embodiment, the baffle 1006 is generally flat and configured to have trays located thereon. In one embodiment, the baffle 1006 may slow the flow of cold air downwardly through, for example, a refrigerated retail display, and past the trays on the retail shelf 1001.

Figure 17A:
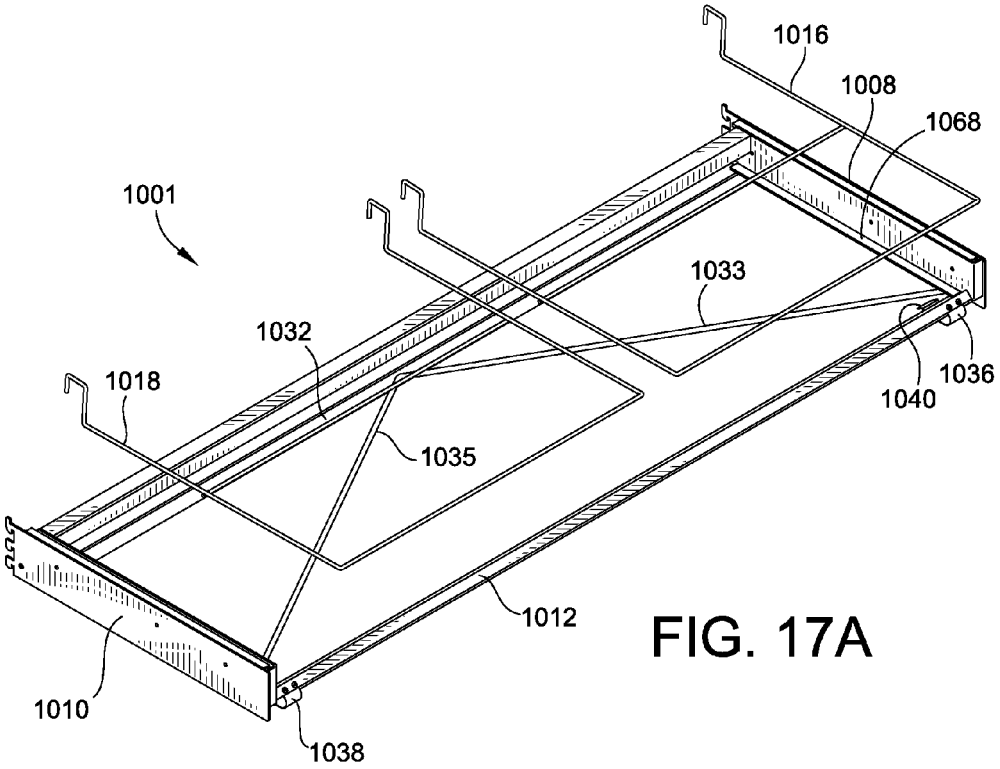
FIG. 17A is a left side perspective view of an embodiment of a retail shelf with the baffle removed and wire support hangers in an exploded configuration.

With reference to FIGS. 16-17A, in one embodiment, the shelf 1001 includes a first wire support hanger 1016 and a second wire support hanger 1018. The first wire support hanger 1016 includes a first support structure illustrated as a first hook 1020 configured to engage the rear retail merchandise display bar 1014 to support the first wire support hanger 1016. Extending from the first hook 1020, the first wire support hanger 1016 includes a first portion 1022 extending generally along the first sidewall 1008 toward the front bar 1012. The hanger 1016 also includes a second portion 1024 extending from the end of the first portion 1022 proximate the front bar 1012 generally perpendicular to the first portion 1022 along the front bar 1012 in a direction toward the second sidewall 1010. The hanger 1016 also includes a third portion 1026 extending from the end of the second portion 1024 opposite the first portion 1022 generally perpendicular to the second portion 1024 and generally parallel to the first portion 1022 toward the rear retail merchandise display bar 1014. The hanger 1016 also includes a second hook 1028 extending from the third portion 1026 configured to engage the rear retail merchandise display bar 1014 to support the first wire support hanger 1016. The hanger 1016 also includes a bar, shown as support bar 1030, extending between the first portion 1022 and the third portion 1026 in a direction generally parallel to the second portion 1024 at a location between the front bar 1012 and the rear retail merchandise display bar 1014. In one embodiment, the support bar 1030 may provide rigidity for the hanger 1016 and may provide support for the baffle 1006 and the trays 1002 located on the baffle 1006. In one embodiment, the third portion 1026 is located approximately midway between the front bar 1012 and the rear retail merchandise display bar 1014. In one embodiment, the second wire support hanger 1018 is generally identical to the first wire support hanger 1016. In the illustrated embodiment, the first wire support hanger 1016 is located proximate the sidewall 1008 and the second wire support hanger 1018 is located proximate the sidewall 1010. In one embodiment, the inner peripheral edges of the wire support hangers 1016 and 1018 are located proximate one another. In other embodiments, additional wire support hangers may be provided.

While the baffle 1006 is shown removed from the wire support hangers 1016 and 1018 for clarity and easy of explanation, in one embodiment, the baffle 1006 is configured to be non-removable from the wire support hangers 1016 and 1018.

With reference to FIGS. 17 and 17A, an embodiment of a retail shelf 1001 is illustrated in an extended configuration, e.g., a displaceable portion 1003 is in an extended configuration relative to a fixed portion 1005 of the retail shelf 1001. The fixed portion 1005 of the retail shelf 1001 includes a lower rear bar 1032. The lower rear bar 1032 extends between the first sidewall 1008 and the second sidewall 1010 generally lower than the rear retail merchandise display bar 1014 proximate the rear portion of the retail shelf 1001. The fixed portion 1005 of the retail shelf 1001 also includes a lower front bar 1034. The lower front bar 1034 extends between the first sidewall 1008 and the second sidewall 1010 generally lower than the front bar 1012 proximate the customer side of the retail shelf 1001. The fixed portion 1005 of the retail shelf 1001 also includes a lower support, illustrated in FIGS. 17-18 as angular support members 1033 and 1035. The first angular support member 1033 extends generally from the first sidewall 1008 proximate the customer side to a location on the lower rear bar 1032 between the first sidewall 1008 and the second sidewall 1010. The second angular support member 1035 extends generally from the lower rear bar 1032 proximate the first angular support member 1033 to the second sidewall 1010 proximate the customer side. The angular support members 1033 and 1035 may provide support for the baffle 1006 and the trays when the displaceable portion 1003 is in a retracted configuration.

Figure 18:
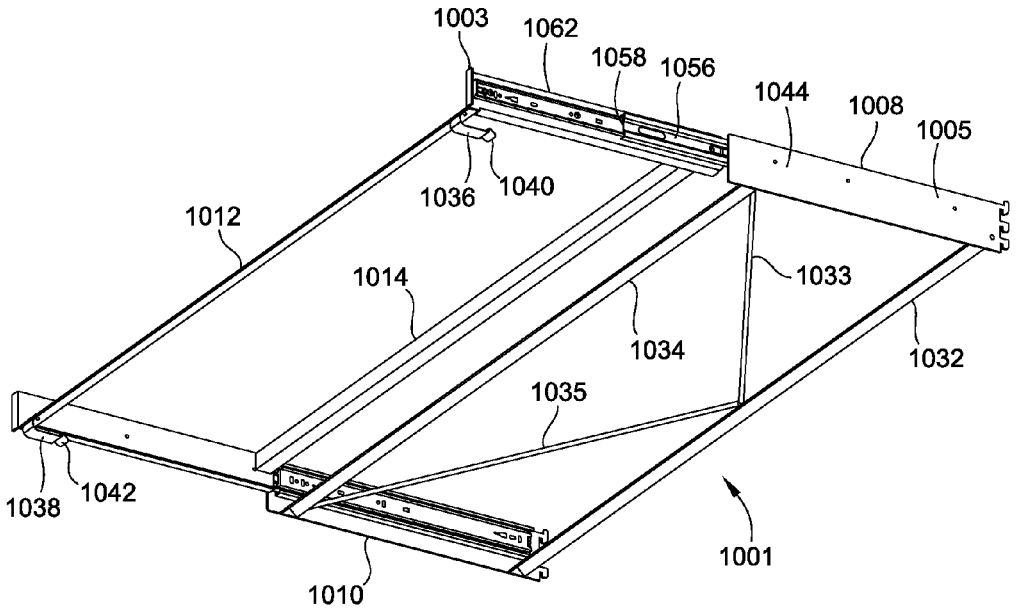
FIG. 18 is a perspective view of an embodiment of a retail shelf in an extended configuration with the baffle and wire support hangers removed.
Figure 19:
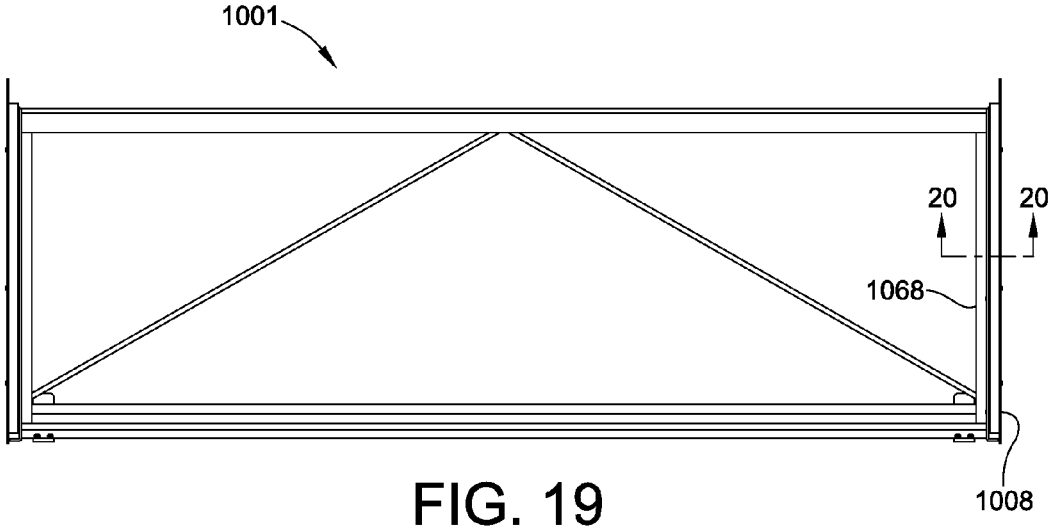
FIG. 19 is a top plan view of an embodiment of a retail shelf in a retracted configuration with the baffle and wire support hangers removed.

With further reference to FIGS. 17-18, in one embodiment, the displaceable portion 1003 of the retail shelf 1001 includes a securing feature illustrated as a pair of clips 1036 and 1038. The clips 1036 and 1038 are each coupled to opposite ends of the front bar 1012 and extend away from the customer side. When the displaceable portion 1003 is in a retracted configuration relative to the fixed portion 1005, the clips 1036 and 1038 each extend around the lower front bar 1034 of the fixed portion 1005 and each include a catch 1040 and 1042. When the catches 1040 and 1042 are in a first configuration, the catches 1040 and 1042 will interact with the lower front bar 1034 to prevent movement of the movable portion 1003 relative to the fixed portion 1005, e.g., movement of the movable portion 1003 from a retracted configuration to an extended configuration, in a direction from rear to front, e.g., toward the customer side. When the catches 1040 and 1042 are in a second configuration, e.g., with the catches 1040 and 1042 moved downwardly to avoid interaction with the lower front bar 1034, the displaceable portion 1003 may be pulled out from the fixed portion 1005, moving the displaceable portion 1003 from a retracted configuration to an extended configuration, e.g., by a retail employee to refill trays with FIFO products. In one embodiment, the catches 1040 and 1042 are biased toward the first configuration, e.g., tend to move into interaction with the lower front bar 1034 to prevent movement of the displaceable portion 1003 relative to the fixed portion 1005 automatically when the movable portion 1003 is again moved to a retracted configuration, e.g., pushed in relative to the fixed portion 1005 in a direction from front to rear.

Figure 20:
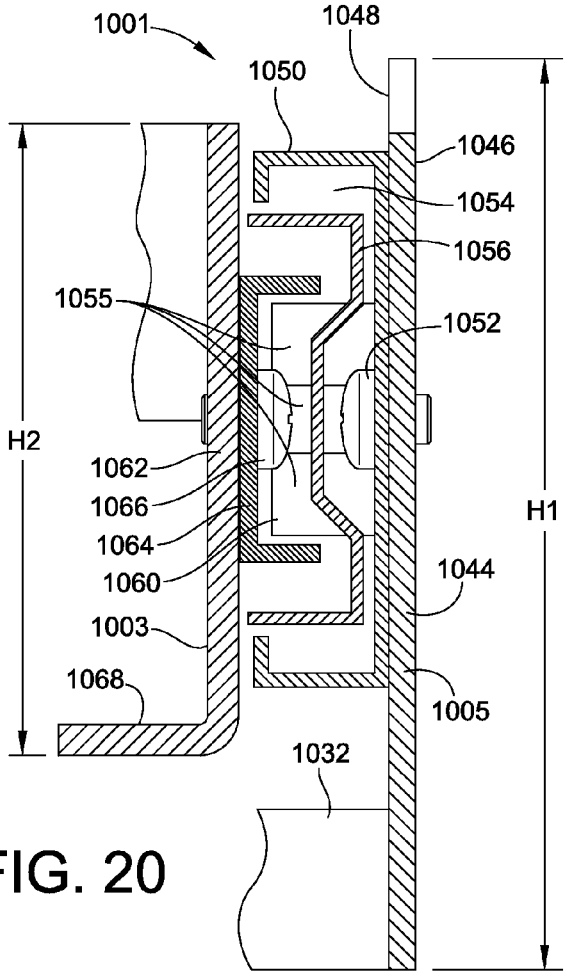
FIG. 20 is a cross-sectional view taken along the line 20-20 in FIG. 19.

With reference to FIGS. 18-21, portions of an embodiment of a retail shelf 1001 providing for sliding movement of the displaceable portion 1003 relative to the fixed portion 1005 are described. In FIG. 20, one sidewall 1008 is illustrated and described. In one embodiment, the other sidewall 1010 is a mirror image of the sidewall 1008. The fixed portion 1005 includes an outer wall 1044 including an outer surface 1046 and an inner surface 1048. Coupled to the outer wall 1044 and extending inwardly from the inner surface 1048 is a track 1050. The track 1050 has a closed outer side coupled to the outer wall 1044 by at least one fastener, shown in FIG. 20 as a bolt 1052, and an open inner side. The track 1050 defines a channel 1054 extending in a direction from the rear to the front of the sidewall 1008 generally parallel to the outer wall 1044.

In one embodiment, located in the channel 1054 is a first slide 1056. The first slide 1056 is configured to slide in the channel 1054 in a direction from the rear toward the front to a configuration with the front end 1058 (see FIG. 18) of the first slide 1056 located past the lower front bar 1034. The first slide 1056 is also configured to move and/or slide back in a direction from the front toward the rear to move the displaceable portion 1003 back into the retracted configuration. Also located in the channel 1054 and extending from the closed outer side into the channel 1054 is a stop, illustrated as three rollers 1055 configured to limit rearward movement of the first slide 1056. The first slide 1056 includes a closed outer side and an open inner side and defines a channel 1060.

With further reference to FIGS. 18-21, in one embodiment, the displaceable portion 1003 includes an inner wall 1062. The inner wall 1062 extends generally parallel to the outer wall 1044 of the fixed portion 1005. The outer wall 1004 has a height H1. The inner wall 1062 has a height H2. In one embodiment, the height H2 is less than the height H1. The inner wall 1062 and the front bar 1012 (see FIG. 21) are configured to allow the front bar 1012 and the inner wall 1062 to pass the lower front bar 1034 of the fixed portion 1005 and allow the displaceable portion 1003 to move from the retracted configuration to the extended configuration.

In one embodiment, a second slide 1064 is coupled to and extends outwardly from the outer surface of the inner wall 1062. The second slide 1064 includes a closed side proximate the inner wall 1062 and an outwardly facing open side opposite the closed side. The closed side is coupled to the inner wall 1062 by at least one fastener, shown in the illustrated embodiment as bolt 1066. The second slide 1062 is located in the channel 1060 defined by the first slide 1056 and is configured to slide in the channel 1060 in a direction from the rear toward the front to move the displaceable portion 1003 to the extended configuration and in a direction from the front toward the rear to move the displaceable portion 1003 into the retracted configuration.

With reference to FIG. 20, in one embodiment the displaceable portion 1003 includes an inwardly extending wall 1068. The inwardly extending wall 1068 extends inwardly generally perpendicular to the inner wall 1062 from the lower peripheral edge of the inner wall 1062. In one embodiment, inwardly extending wall 1068 (along with a similarly inwardly extending wall extending inwardly from an inner wall of a moveable portion of the second sidewall 1010) are configured to support the baffle 1006 (see FIG. 16) with an outer peripheral portion of the baffle 1006 being located on the inwardly extending wall 1068.

With reference to FIG. 17A, in one embodiment, the angular support 1033 is coupled to the outer wall 1044 at a height vertically lower than the inwardly extending wall 1068 and extends below the inwardly extending wall 1068 to the lower rear bar 1032. Similarly, the angular support 1035 is coupled to the outer wall (not shown in FIG. 17A) of the sidewall 1010 and passes below the inwardly extending wall of the sidewall 1010.

Figure 21:
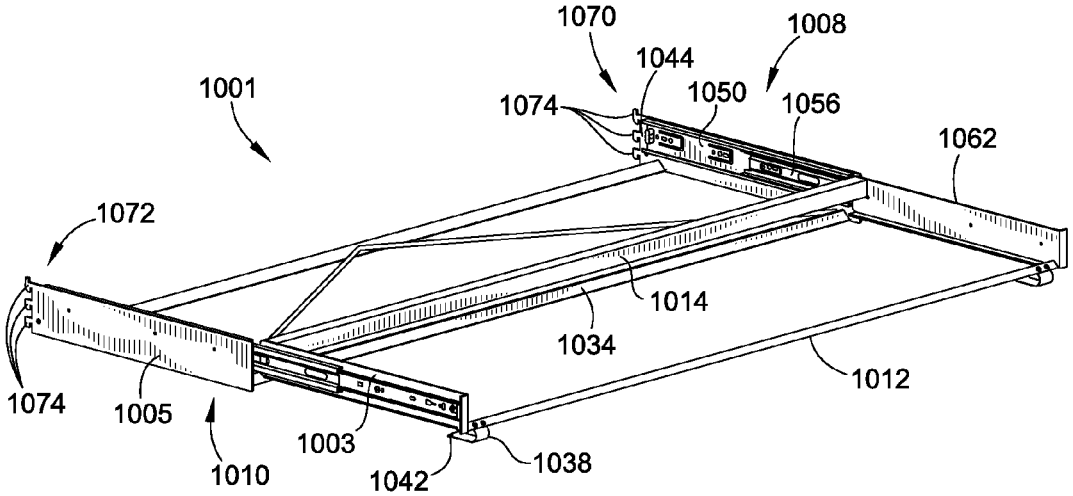
FIG. 21 is a perspective view of an embodiment of a retail shelf in an extended configuration with the baffle and wire support hangers removed.

With reference to FIG. 21, each of the sidewalls 1008 and 1010 includes a coupling feature 1070 and 1072. The coupling features 1070 and 1072 each include a plurality of teeth 1074 extending in a direction generally perpendicular to the sidewalls 1008 and 1010. In the illustrated embodiment, the teeth 1074 are formed integrally with the outer sidewalls the outer walls 1044. The coupling features 1070 and 1072 are configured to couple the retail shelf 1001 to a retail display, such as, for example, vertical supports of the retail display, to support the retail shelf 1001 and fix the fixed portion 1005 of the shelf 1001 relative to the retail display.

With reference to FIGS. 1, 2, and 16-22 generally, in one embodiment, trays 1002, such as those described above, are loaded onto a retail shelf 1001 with hooks of the trays 1002 coupling the trays 1002 to the rear retail merchandise display bar 1014 of the displaceable portion 1003 of the shelf 1001. The clips 1036 and 1038 are moved to release the catches 1040 and 1042 from the lower front bar 1034 to allow the moveable portion to move, e.g., be pulled out by a user, for example, a retail employee loading trays with FIFO merchandise, from the retracted configuration to an extended configuration. In moving from the retracted configuration to the extended configuration, in one embodiment, the first slide 1056 moves through the channel 1054 of the track 1050 with the second slide 1064 remaining in the channel 1060 defined by the first slide 1056. Once the first slide 1056 reaches the end of the channel 1054 of the track 1050 (which, for example, it may be restricted from being completely withdrawn from by various mechanisms, e.g., various stopping mechanisms, clips may be formed into the drawer slide stamping, etc.), then the second slide 1064 begins to slide axially out from the channel 1060 of the first slide 1056 until the displaceable portion 1003 reaches its extended configuration relative to the fixed portion 1005. With the displaceable portion 1003 in its extended configuration, a user, for example, a store employee restocking the trays with FIFO merchandise, may have access to the rear, e.g., distal from the customer side, of the trays and may restock the trays with FIFO merchandise placing the newest merchandise towards the back of the trays, e.g., distal from the customer side. Upon loading, the displaceable portion 1003 may be returned to its retracted configuration.

Figure 22:
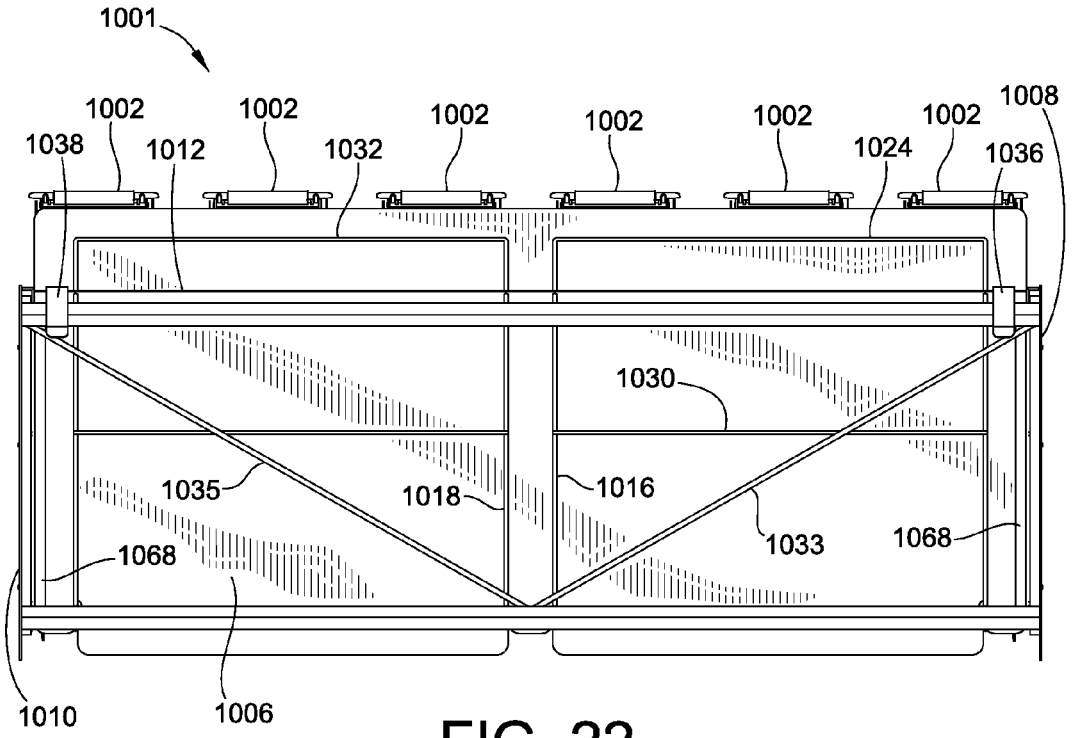
FIG. 22 is a bottom plan view of an embodiment of a retail shelf.

With reference to FIG. 22, in one embodiment, the wire support hangers 1016 and 1018 are hooked on the rear retail merchandise display bar 1014 (not shown in FIG. 22) and extend past the front bar 1012 and are supported by both the rear retail merchandise display bar 1014 and the front bar 1012. The baffle 1006 is supported on the wire support hangers 1016 and 1018 and extends from the rear of the shelf 1001 past the front bar 1012. The baffle 1006 also extends between the inwardly extending walls 1068 and is supported thereon. The support bar 1030 of each of the wire support hangers 1016 and 1018 may also help to support the baffle 1006. Additionally, the angular support members 1033 and 1035 may support the wire support hangers 1016 and 1018 and/or the baffle 1006 when the displaceable portion 1003 is in the retracted configuration relative to the fixed portion 1005, for example, if the baffle 1006 and/or wire support hangers 1016 and 1018 are deflected downwardly under the load of trays.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail shelf having a front side and a rear side, the retail shelf comprising:

a first frame portion and a displaceable frame portion configured to be moved between a retracted configuration and an extended configuration relative to the first frame portion;

wherein the first frame portion includes a coupling feature configured to couple the first frame portion to a retail display to maintain the location of the first frame portion relative to the retail display;

wherein a generally planar baffle having an upper surface and a lower surface is mounted upon a support formed of bent wire; wherein upper surface of the baffle is capable of supporting a plurality of retail trays and the lower surface is configured to rest upon the support;

wherein a portion of the support extends through the baffle and includes a downwardly opening hook element for mounting to the displaceable frame portion in order to attach the baffle to the displaceable frame portion wherein the displaceable portion is configured to or capable of supporting a plurality of retail trays;

wherein the displaceable portion includes a baffle;

wherein the displaceable portion includes a support mounted thereon and formed of bent wire, the support configured to support the baffle (FIG. 3, #80), the support including downwardly opening hook elements for mounting to the displaceable portion.

2. The retail shelf of claim 1, wherein the displaceable portion includes a pair of inner sidewalls and a rear support extending between the inner sidewalls configured to interact with hooks of the retail trays to couple the retail trays to the moveable portion; and wherein the first portion includes a pair of outer sidewalls.

3. The retail shelf of claim 2, wherein the displaceable portion includes a first bar extending between the inner sidewalls proximate the front side;

wherein the first portion includes a second bar extending between the outer sidewalls; and wherein the displaceable portion includes securing feature configured to couple the first bar to the second bar in a first configuration to deter movement of the displaceable portion relative to the first portion.

4. The retail shelf of claim 3, wherein the securing feature is configured to be displaced from the first configuration to a second configuration to allow movement of the displaceable portion relative to the first portion from the retracted configuration to the extended configuration.

5. The retail shelf of claim 3, wherein the inner sidewalls each have a lower periphery and the outer sidewalls each have a lower periphery;

wherein lower peripheries of the outer sidewalls are lower than the lower peripheries of the inner sidewalls; and wherein the first portion includes a lower bar extending between the outer sidewalls proximate the rear side lower than the rear support.

6. The retail shelf of claim 5, wherein the displaceable portion includes an inwardly extending wall extending inwardly from each of the inner sidewalls; and wherein the baffle is supported on and extends between the inwardly extending walls.

7. The retail shelf of claim 5, wherein the first portion includes a first angular support extending from one of the outer sidewalls proximate the second bar to the lower bar and a second angular support extending from the other of the outer sidewalls proximate the second bar to the lower bar.

8. The retail shelf of claim 1, wherein the first portion includes a track and the displaceable portion includes a slide, with the slide configured to be slidably moveable in the track to allow the displaceable portion to slide between the retracted configuration and the extended configuration.

9. The retail shelf of claim 2, wherein the coupling feature includes a plurality of downwardly extending teeth integrally formed with one of the pair of outer sidewalls.

10. A retail shelf comprising:

A first portion;

a displaceable portion configured to be displaced between a retracted configuration and an extended configuration relative to the first portion; and a securing feature configured to move between a first configuration and a second configuration, the securing feature being configured to deter movement of the displaceable portion from the retracted configuration to the extended configuration in the first configuration and to allow movement of the displaceable portion from the retracted configuration to the extended configuration in the second configuration;

wherein the first portion includes a pair of outer sidewalls, a front bar, and a rear bar, the front and rear bars extending between the sidewalls;

wherein the first portion includes a coupling feature configured to couple to a retail display to maintain the location of the first portion relative to the retail display;

wherein displaceable portion includes a pair of inner sidewalls, each of the inner sidewalls being located inwardly of the respective one of the outer sidewalk, a first support and a second support, the first and second supports extending between the inner sidewalls;

wherein the displaceable portion includes inwardly extending walls extending inwardly from each of the inner sidewalls;

wherein the displaceable portion includes a third support supported by the first support and the second support;

wherein the displaceable portion includes a baffle extending between the inwardly extending walls and supported by the inwardly extending walls and the third support;

wherein the displaceable portion is configured to support a plurality of retail trays; and wherein the third support includes a hook configured to couple the third support to the second support;

wherein the third support is a wire support hanger including a first portion extending generally parallel to the inner sidewall from the hook to a second portion extending generally perpendicular to the first portion from the first portion to a third portion extending generally parallel to the first portion, the third portion extending from the second portion to a second hook configured to couple the third support to the second support, and a fourth support portion extending between the first portion and the third portion between the second portion and the hooks.

11. The retail shelf of claim 10, wherein the securing feature is biased toward the first configuration.

12. The retail shelf of claim 10, wherein the inwardly extending walls of the displaceable portion are located above the rear bar of the first portion.

13. The retail shelf of claim 10, wherein the outer sidewalls each include a lower peripheral edge;

wherein the inner sidewalls each include a lower peripheral edge; and wherein the lower peripheral edges of the outer sidewalls are lower than the lower peripheral edges of the inner sidewalls.

* * * * *